US007900845B2

(12) United States Patent
Stagg

(10) Patent No.: US 7,900,845 B2
(45) Date of Patent: Mar. 8, 2011

(54) COMPOSITE MAGNETIC CARDS

(75) Inventor: Malcolm J. Stagg, Oakville (CA)

(73) Assignee: SnapNwin Inc., Oakville, ON (CA)

( * ) Notice: Subject to any disclaimer, the term of this patent is extended or adjusted under 35 U.S.C. 154(b) by 0 days.

(21) Appl. No.: 12/524,384

(22) PCT Filed: Feb. 8, 2008

(86) PCT No.: PCT/CA2008/000249

§ 371 (c)(1),
(2), (4) Date: Jul. 24, 2009

(87) PCT Pub. No.: WO2008/101315

PCT Pub. Date: Aug. 28, 2008

(65) Prior Publication Data

US 2010/0096465 A1 Apr. 22, 2010

Related U.S. Application Data

(63) Continuation-in-part of application No. 11/707,998, filed on Feb. 20, 2007, now Pat. No. 7,707,758.

(51) Int. Cl.
*G09F 7/04* (2006.01)

(52) U.S. Cl. ..... 235/493; 283/101; 40/600

(58) Field of Classification Search ..... 235/487, 235/493; 283/101; 40/600
See application file for complete search history.

(56) References Cited

U.S. PATENT DOCUMENTS 3,230,650 A 1/1966 Orkin
5,284,365 A 2/1994 Stuart
5,458,282 A * 10/1995 Martin ..... 229/92.8
5,736,212 A 4/1998 Fischer
6,153,279 A * 11/2000 Charley ..... 428/40.1
6,217,405 B1 4/2001 Burrows
6,508,904 B1 * 1/2003 Charley ..... 156/249

(Continued)

FOREIGN PATENT DOCUMENTS

CA 2322347 A1 4/2002

(Continued)

OTHER PUBLICATIONS

PCT International Search Report in PCT/CA2008/000249 dated May 9, 2008.

(Continued)

*Primary Examiner* — Daniel A Hess
(74) *Attorney, Agent, or Firm* — Manelli Denison & Selter PLLC; Edward J. Stemberger

(57) ABSTRACT

A composite magnetic card for bearing printed data and suitable for mailing purposes comprising (a) a first planar sheet of paper cardstock having a first face and second face; (b) a second planar sheet comprising a magnetic material having a first face and a second face and defining at least one detachable portion defined by a die cut while having suitably located portions integrally retained to non-detachable magnetic material of the second planar sheet; wherein the first sheet first face is sufficiently and suitably adhered with an adhesive to the second sheet first face to retain the detachable portion of the second sheet to the first sheet but wherein the adhesive is not disposed at first selected locations between the first sheet and the second sheet within the card. The resultant card after the detachable portion has been removed is adhesive-free to provide a non-sticky, clear area of the card, which may be readily used to clearly displace further desired data.

23 Claims, 5 Drawing Sheets

U.S. PATENT DOCUMENTS

| | | | | |
|---|---|---|---|---|
| 6,773,181 | B2 | 8/2004 | Crum | |
| 6,824,135 | B2 | 11/2004 | Stancik | |
| 6,986,953 | B2 | 1/2006 | Crum | |
| 7,225,568 | B1 * | 6/2007 | Rizzo et al. | 40/600 |
| 7,293,701 | B2 * | 11/2007 | Halbur et al. | 235/380 |
| 7,707,758 | B2 * | 5/2010 | Stagg | 40/600 |
| 2002/0130511 | A1 | 9/2002 | Thompson et al. | |
| 2003/0049403 | A1 | 3/2003 | Crum | |
| 2003/0049404 | A1 | 3/2003 | Mercer et al. | |
| 2003/0067159 | A1 * | 4/2003 | Ritchie et al. | 283/101 |
| 2003/0070338 | A1 * | 4/2003 | Roshkoff | 40/638 |
| 2003/0077465 | A1 * | 4/2003 | Boudouris et al. | 428/469 |
| 2003/0090103 | A1 * | 5/2003 | Becker | 283/56 |
| 2004/0247366 | A1 | 12/2004 | Crum | |
| 2005/0040640 | A1 * | 2/2005 | Becker | 283/56 |
| 2005/0163980 | A1 * | 7/2005 | Crum | 428/200 |
| 2006/0036492 | A1 * | 2/2006 | Becker | 705/14 |
| 2006/0037221 | A1 * | 2/2006 | Reynolds | 40/124.04 |
| 2006/0087112 | A1 * | 4/2006 | Ritchie et al. | 283/101 |
| 2006/0151340 | A1 | 7/2006 | Meister | |
| 2006/0248765 | A1 | 11/2006 | Bodinet | |
| 2007/0029789 | A1 | 2/2007 | Lowry et al. | |
| 2007/0256342 | A1 * | 11/2007 | Marquardt et al. | 40/611.01 |
| 2008/0173702 | A1 * | 7/2008 | Meister | 229/78.2 |
| 2008/0196284 | A1 * | 8/2008 | Stagg | 40/124.04 |
| 2008/0217907 | A1 * | 9/2008 | Dean et al. | 283/82 |
| 2009/0193629 | A1 * | 8/2009 | Suenaga | 24/303 |

FOREIGN PATENT DOCUMENTS

| | | | |
|---|---|---|---|
| CA | 2351142 | A1 | 12/2002 |

OTHER PUBLICATIONS

European Search Report in corresponding EP 08714572.8 issued on Aug. 26, 2010.

* cited by examiner

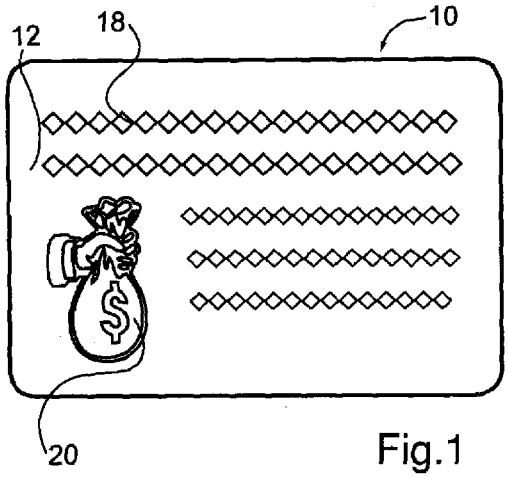
Fig.1
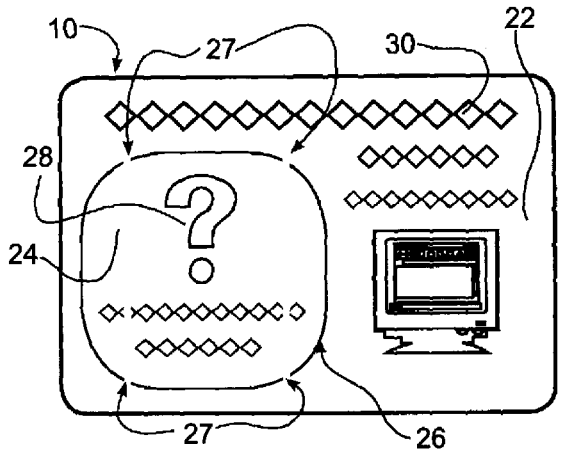
Fig.2
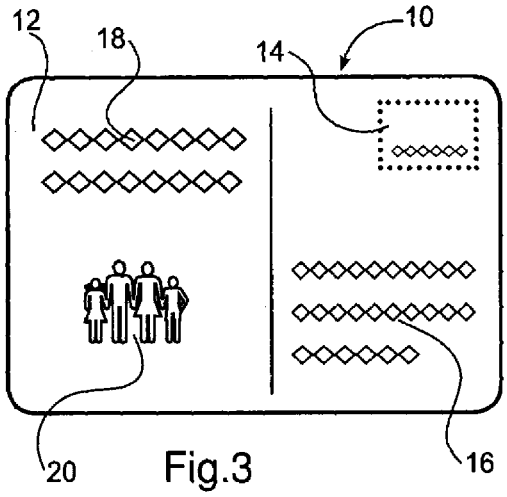
Fig.3
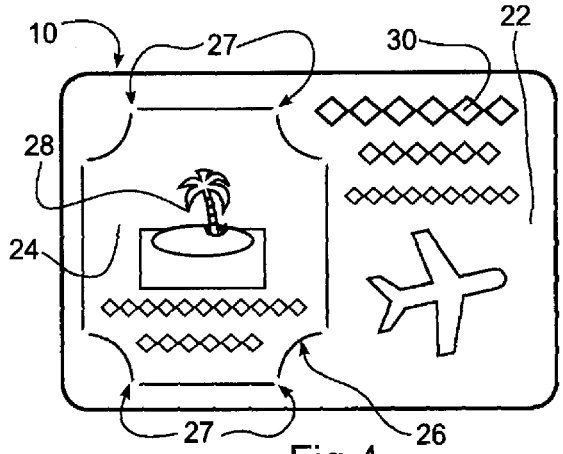
Fig.4
Fig.5
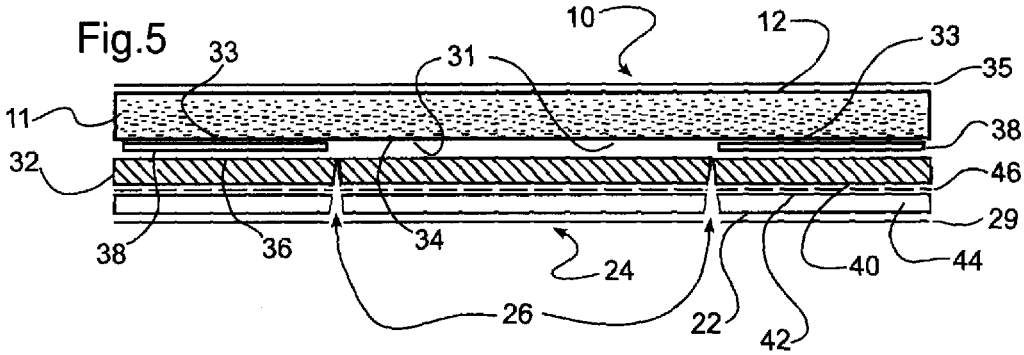

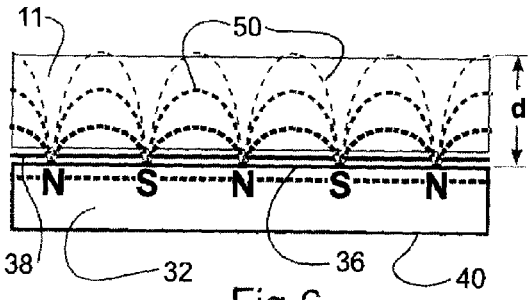
Fig.6
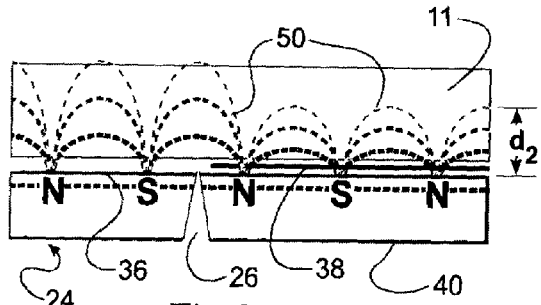
Fig.7
Fig.8
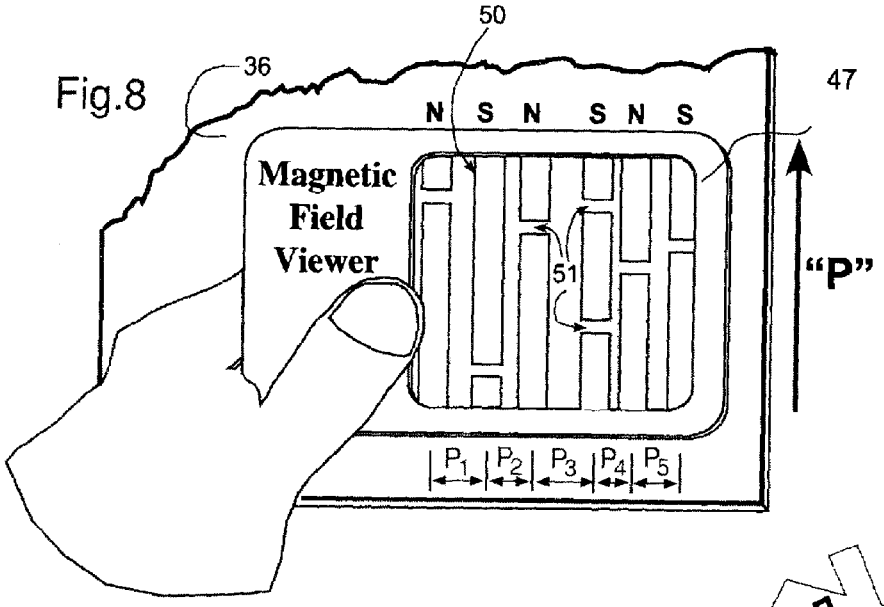
Fig.9
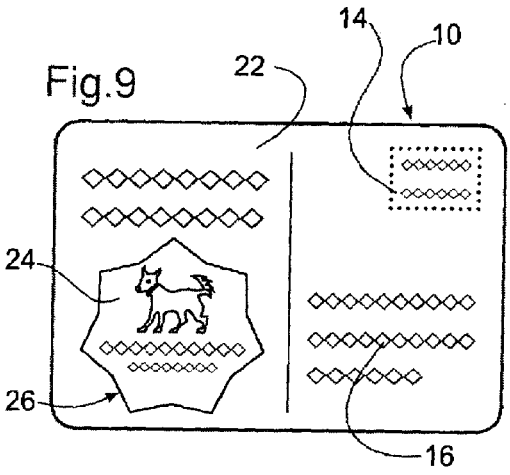
Fig.10
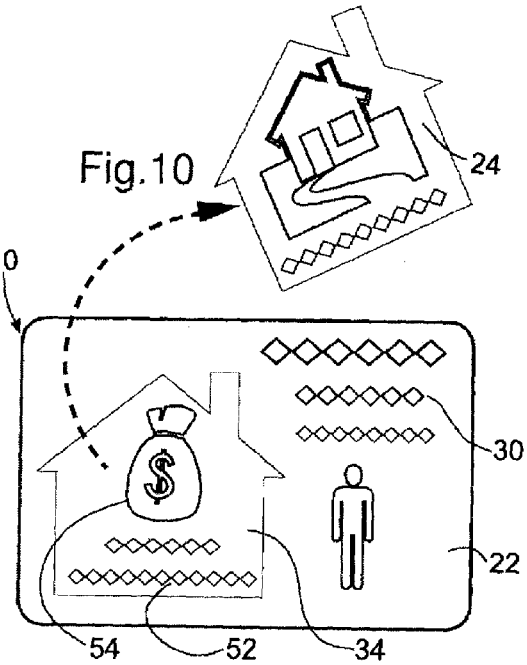

Fig.11
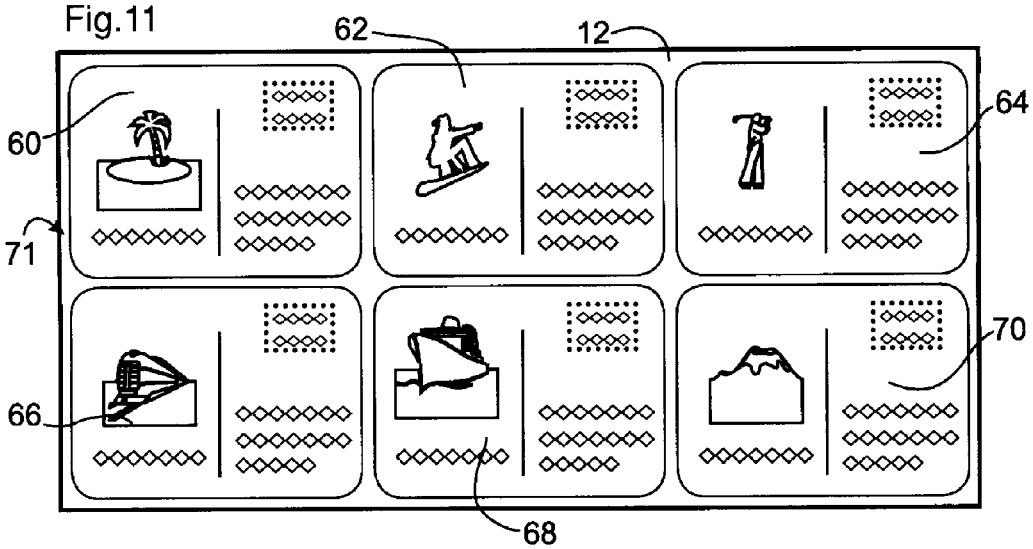
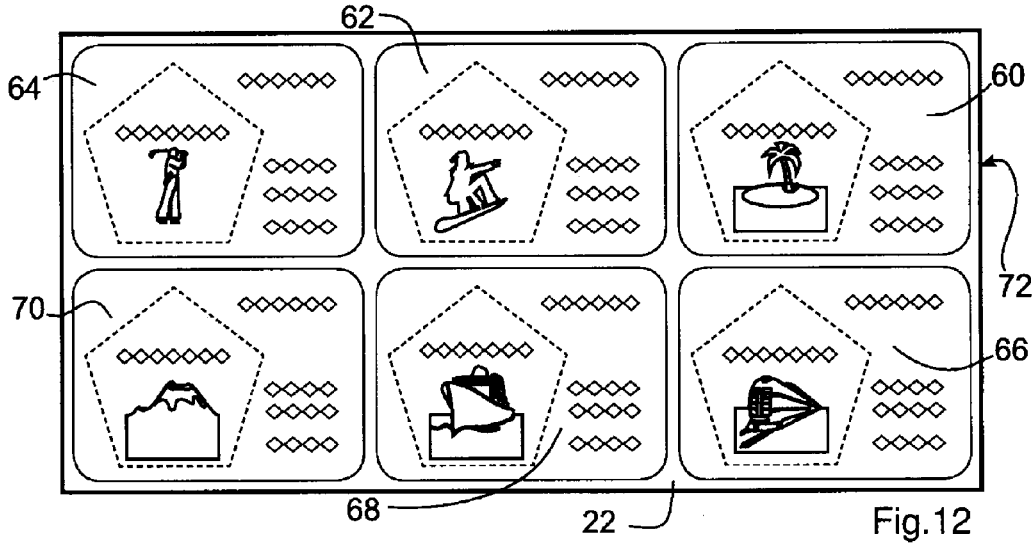
Fig.12
Fig.11a
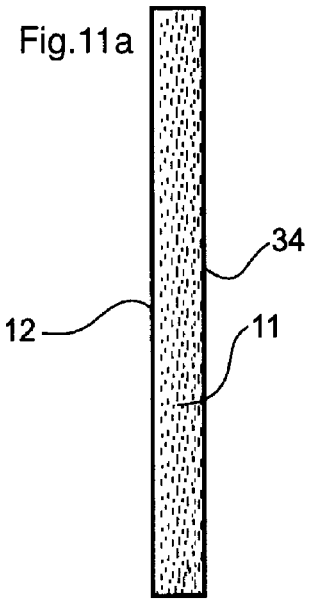
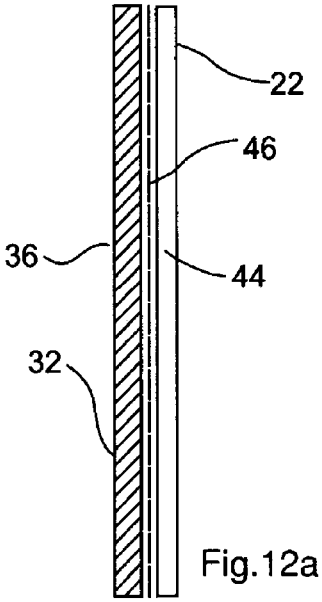
Fig.12a

COMPOSITE MAGNETIC CARDS

This application is the National Stage of International Application No. PCT/CA2008/000249, filed on Feb. 8, 2008 which is continuation-in-part of U.S. application Ser. No. 11/707,998, filed on Feb. 20, 2007, now U.S. Pat. No. 7,707,758, which is hereby incorporated by reference into this specification.

FIELD OF THE INVENTION

This invention relates to composite cards comprising a laminate of a printable opaque magnetic sheet and a cardstock material printable on both sides. Said cards containing a securely hidden message, and a removable souvenir magnet, suitable for instant win contests, sales promotions, educational or marketing message purposes, games, and lotteries; and to processes of manufacturing said cards.

BACKGROUND OF THE INVENTION

Instant win lotteries, contests and promotions have been in use for over 30 years. The most ubiquitous in present usage, being the "scratch and win" card. This card consists of a printed cardstock material, where the hidden message is concealed by a layer of removable latex ink. The user scratches the removable layer with a coin or fingernail exposing the underlying message.

The scratch and win cards have in-use limitations of requiring a solid surface to place the card on to scratch off the latex, as well as the undesirable residue left under fingernails or on counter tops by scratching. Due to the inherently frangible property of the latex layer, it is also vulnerable to unanticipated abrasive removal by handling, movement in a clothing pocket or in mail system when applied to a postcard. In addition these cards are susceptible to being compromised by lightly scratching with a pin or other methods to reveal identification of the prize message below. Due to the thin and less than total opacity of the latex layer, the cards are often necessarily laminated with metallic foil to avoid the hidden message being visible under a strong light, adding an extra cost and complexity to the product.

Flexible magnetic sheeting has been in use for over 50 years to produce advertising specialty items commonly referred to as "refrigerator magnets. These are used in both home and business environments and provide a long-lasting, effective, advertising medium when stuck to a metal surface, such as a refrigerator door, school locker, filing cabinet and the like.

Traditionally, the magnetic sheeting has been manufactured as a thin, calendared sheet of rubber or plastic containing strontium ferrite powder. The magnetization has normally been accomplished at the time of manufacture and consists of imparting a multi-pole array to provide a coercive (magnetic) force primarily to one side of the sheet. This magnetic material is sold in rolls or master sheets to advertising specialty converters who print them with an advertising message and then die cut into shapes for the advertiser. Printing was originally done by silk screening onto a vinyl surfaced sheet bonded to the magnetic polymer material. A subsequent process that became more popular was offset process printing onto a separate paper sheet and bonding the printed paper sheet to the magnetic sheet. This has been replaced to a large extent now by inkjet and digital printing due to the superior economy of digital printing for shorter production runs and the high quality now associated with digital printing. The printed paper has often been laminated with a clear thin polymer film or UV light-cured clear polymer coating for appearance and smudge resistance prior to bonding to the magnetic sheet. The traditional thickness of flexible magnetic sheeting is 0.3 mm to 0.75 mm thick. After printing the sheet is then die cut, into many smaller pieces from a size of 5 cm×5 cm upwards, in conventional or decorative shapes.

These magnets often contain advertising messages, and/or may be made in the shape and printed image of a souvenir or collectible item of interest to the end-user. In use they also are capable of holding up sheets of paper for reference by the end user. Given the practical and convenient use of these magnets, they are often kept and used for a long period of time, benefiting the advertiser with a long-lasting message and end-user with a decorative, item fulfilling a practical need.

One of the goals of an advertiser is to minimize the cost to have these magnets made, printed and delivered to the end-user. To minimize the cost of delivery, direct mail has been a desired choice, with automated "machinable" mail which can be scanned with automatic bar code reading equipment being the lowest cost. In addition, avoiding multiple steps in production, or complex or manual fabrication keeps costs lower. The simplest mail piece configuration, a postcard avoids the labour and material costs to fold, stuff, and seal and address envelopes and may qualify for lower mass mailing rates.

Another goal is to maximize the probability of the end user reading, and being motivated to keep the magnetic advertising piece, in that way increasing the probability of a purchase or use of the advertising or message, and a higher return on the advertising investment. Increasingly this involves being able to personalize the message to make it relevant to the end-user. With digital printing, unlike offset process or silk screening, it is feasible to have each mail piece unique in its content and images. Databases with information on demographics, past purchasing habits, household income, or such details as presence/absence of children or pets are widely utilized by advertisers. They are incorporated into variable data software in the digital printing process. In addition advertisers can direct end-users to personalized website addresses to enter contests or purchase services.

To obtain problem-free personalization it is advantageous not to have multiple pieces to assemble and in the case of magnets, to avoid trying to sort the die cut magnet pieces to match up the names with an envelope or insert.

With the above factors and the significant weight of the magnet, and the postal sorting problems of the inherent coercive force it has been difficult to achieve low cost mailings with magnets that were effective advertising mediums.

One example of an attempt to overcome these issues is provided in U.S. Pat. No. 5,458,282, issued Oct. 17, 1995 to Crane Productions Inc. Here a magnetic sheet is bonded to one end of a postcard, which is perforated to allow the magnetic portion to be removed. The limitation with the teaching of this example of prior art is that it leaves a magnet force facing outward, potentially jamming sortation equipment, the rough perforated edge to the magnet, the dual thickness affecting stacking of the finished product, and the loss of advertising space taken up by the face of the plain brown magnetic sheet.

An improvement on this prior art by the same inventor, Martin, in U.S. Pat. No. 5,676,307, issued Oct. 14, 1997 to Crane Productions Inc., provides for a tape to be applied to the back of the postcard along the edge of the magnet sheet. This "ramp" is claimed to reduce mailing problems by making the stacking of the cards easier by reducing the sharp "bump" at the edge of the magnetic sheet adhered to the postcard which made the machine stacking of the postcard problematic.

In another patent by Martin, U.S. Pat. No. 6,024,278, issued Feb. 15, 2000 to Crane Productions, Inc. a mailable envelope containing coupons is described. In this prior art a cardstock envelope is constructed with a magnetic sheet on the front, said sheet having a printed face containing postal indicia and address information. In this envelope, coupons are placed with the magnetic sheet holding it to the metal surface. The limitation of this prior art is the cost of assembling a complex multiple part piece and the mailing weight involved.

In U.S. Pat. No. 6,153,280, issued Nov. 28, 2000 to Magnet, LLC, discloses the use of a magnetic strip applied to the back of a postcard, which is internally perforated to allow a portion of the magnetic backed portion to be removed. This has the continuing problem of not being automated mail compatible, and has the same issue as the aforesaid prior art with the unattractive brown magnetic face taking up a significant portion of one side of the card.

U.S. Pat. No. 6,986,953, issued Jan. 17, 2006 to Ward/Kraft Inc., describes a one-side only printed magnetic sheet consisting of a printable paper surface, bonded to a pre-magnetized magnetic sheet layer which is bonded with a frangible adhesive across its complete surface to a non-printed release layer. This sheet is printed with souvenir photos or other remembrances on the removable portions. The resultant sheet after the detachable elements have been removed, retains adhesive residue resulting from the frangible coating, which may be sticky.

To seek another method, U.S. Pat. No. 7,063,258, issued Jun. 20, 2006 to Dan Karolewicz, provides for a small annular magnetic shape glued to the back of a card to provide it with the ability to hold itself to a metal surface. This non-planar combination is placed in an envelope for bulk mailing. This prior art has the limitation of rendering the card non-planar like the two earlier instances noted above, and requiring an envelope for mailing.

In common commercial use today, magnetic postcard mailers are marketed with a conventional cardstock postcard on which a printed magnetic shape has been placed and then held in place with an overlying clear laminate film. The magnet is released by using a sharp point or by bursting through a perforated line in the film around the magnet. Due to the loose nature of the printed magnets being dropped onto the cardstock, the magnet generally must be a generic non-personalized one. This method limits the personalization possible, and requires multiple processes to manufacture cards and magnets separately and then bond the two together.

Also, in commercial use by advertisers, is the practice of creating a generic or personalized magnet in the shape of a credit card and then placing this with a removable adhesive securing it onto a folded letter, or card or pamphlet, which is then placed into an addressed window or plain envelope. This magnetic shape may be constructed of a thin magnetic paper laminate to minimize weight. However this still entails the costly issue of being able to match separately produced magnets with a personalized ad or letter and the fact that the removable advertisement piece, the magnet, is hidden inside an envelope, reducing the odds of its use as a refrigerator magnet.

The term "advertisers" as used in this specification takes its usual commercial meaning, but its meaning is not limited to private enterprises seeking to encourage business such as retailers, restaurants, real estate companies, manufacturers or distributors, as examples. The term may also apply to any level of government or other public sector or non-profit organizations, such as social services organizations, city governments, schools, institutions, sports teams, charitable foundations, cultural or religious organization as examples.

Given the limitations of the prior art, there still remains a need for an innovative and effective way of creating multi-purpose magnetic cards. The present invention overcomes these limitations of the prior art by:

a) providing a card with durable, sturdy surfaces that can be easily stored, handled, shipped or mailed without compromising card security
b) Providing a solid completely opaque layer to cover the hidden message, eliminating the need to provide extra layers to create secure opacity
c) offering a quick, clean, debris-free method of revealing the prize or message within, without need for coins, fingernail scratching or a solid surface to rest it on.
d) providing a souvenir decorative magnet of practical end use that may be displayed long-term providing benefits to both the advertiser and end-user.
e) Compatible with modern digital printing methods enabling personalization of the advertising and hidden prize or message.
f) when used as a mail postcard having low enough magnetic field on its surfaces such that it can be processed by automated sorting equipment securing the lowest postal rates.
g) being of a single, uniform and thin enough thickness to enable sorting and stacking without jamming up in machine fed mailing equipment when used as a postcard.
h) designing so that the magnetic forces can be adjusted in the magnetic sheet so that a higher force may be used if the card is for handing out and a lower one if the card is processed by a postal service with stringent specifications or more magnet sensitive processing equipment; and
i) designing so that the magnetization forces can be imparted in unique pattern providing a significant precaution against counterfeiting or tampering
j) Produced with die cut patterns and adhesive placement methods to produce tamper-evident cards.

A magnetic card product with most or all of these advancements would offer significant advantages and overcome the limitations of the prior art as described above.

SUMMARY OF THE INVENTION

The present invention in one aspect comprises a composite magnetic card as hereinafter defined combined with the advantages of a long lasting collectible refrigerator magnet.

Thus, the present invention in one aspect offers novel and superior instant win and promotional cards with superior user appeal, ease of use, security, and with the souvenir removable magnet. The card is novel in providing three features in one card—one or more removable souvenir magnets, the hidden prize or reward message, and advertising messages on the face of the redemption portion of the card.

In a further aspect, this invention offers the established business and end use benefits of both an instant win card and a collectible refrigerator magnet.

In its simplest form, the card contains a flat flexible laminated magnet sheet detachable from a paper cardstock in selected area. In some embodiments, preferably, this composite card is laminated or coated with a polymer on both sides, which protects the magnet, enhances the perceived value of the card.

Further, surprisingly, I have discovered that it is possible in one embodiment to not require an adhesive-frangible or otherwise between the removable magnetic portion and the remainder of the card. I have found that if the magnetic layer is die cut to the desired shape for the shaped detachable portion but leaving non-cut suitably located intermittent portions integral with the magnetic material to be retained to the card, that avoidance of use of an adhesive can be achieved. Non-use of an adhesive results in the card after the desired detachable portion has been detached in the newly visible region not being sticky by residual adhesive and, most preferably, having a clear surface viewable by a recipient to better see any data or design present thereon.

Accordingly, in one aspect, the invention provides a composite magnetic card for bearing printed data comprising (a) a first planar sheet of paper cardstock having a first face and second face;

(b) a second planar sheet comprising a laminate of magnetic material and a paper layer, having a first face and a second face and defining at least one detachable portion defined by a die cut while having suitably located portions integrally retained to non-detachable magnetic material of said second planar sheet;

wherein said first sheet first face is sufficiently and suitably adhered with an adhesive to said second sheet first face to retain said detachable portion of said second sheet to said first sheet but wherein said adhesive is not disposed at first selected locations between said first sheet and said second sheet within said card.

The cards may bear printed data or designations on the first or second or on both faces of the first sheet either directly thereon or on or under the outer polymer surface of a polymer/cardstock laminate.

Similarly, the second sheet comprising the magnetic material may bear printed data or designations directly on its first face; or its second face directly or on or under an outer polymer surface laminate.

Thus, in this aspect, the invention consists of a multi-layer composite card with printable surfaces, optionally, on both sides, and having on one side a magnetic portion defining a desired shape or shapes removable from the card.

The first layer of the composite card is a paper or plastic sheet bonded to the middle layer by means of a permanent adhesive applied solely in the areas outside the magnet cutout. The middle layer is a magnetic sheet, magnetized with its multi-pole pattern of magnetic force on its face adjacent to the first layer. The magnetic layer is bonded to the third layer with a permanent adhesive over its complete surface. Alternatively, the magnetic layer is a magnetizable coating which has been applied to the third layer. The third layer may be constructed from any suitable material, including but not limited to paper, metallic and plastic sheets. Alternatively this layer may not be a separate sheet adhesively bonded to the magnetic layer but a liquid applied polymer coating which is receptive to printed images and text.

In one embodiment, printing is preferably done on both faces of the first layer, the outer print face bearing an advertising or information message, with the inner face bearing a prize or reward message and security identification numbers. The magnetic layer may be printed on its magnetic face for security or advertising purposes. The third layer is printed on its outer face with decorative images or messages for the removable magnet and the retained portion.

A die cut may be made that extends through the third layer and through the magnetic layer, but not through or substantially into the first layer. The die cut when made, is controlled in depth and by use of strategically located non-cut parts, the magnetic piece is retained until it is removed by the end-user.

The magnetizing of the magnetic layer may be done at the time of its manufacture, or in a preferred embodiment of this invention, it may be magnetized during the construction of the finished product. By magnetizing during the printing and die cutting process, the degree and configuration of magnetization may be chosen. In addition, a security pattern may be embedded by creating unique magnetizing patterns, viewable by means of a magnetic field viewer or electronic magnetic reader to minimize the possibility of counterfeiting.

The cards as hereinabove defined preferably further comprise distinctive magnetic field identification means.

In preferred embodiments, the invention provides a card as hereinabove defined wherein the magnetic material provides the card with portions having a plurality of pitches of magnetic field strength.

In further embodiments, the invention provides a card as hereinabove defined wherein the magnetic material provides the card with portions having a plurality of various distances between magnetic force lines and an imparted distinctive magnetic pattern.

Preferably, the card has magnetic material that provides a distinctive pattern of magnetization across the card.

The die cut shape or shapes in the interior portion of the card may be of any regular geometric or fanciful shape. The card so described may contain a multiple number of such shapes, with one or more of these shapes being a non-retained partially die-cut shape hiding a unique verification number or award qualifier that tears upon removal, revealing tell-tale signs of tampering.

Accordingly, in preferred embodiments, the invention provides a card as hereinabove defined further comprising tamper-evidence means comprising the die-cut having a die-cut line so shaped as to provide the suitably located portions integrally retained to said non-detachable magnetic material.

In further preferred embodiments, the invention provides a card as hereinabove defined wherein the die-cut line is of a zig-zag shape.

In further preferred embodiments, the invention provides a card as hereinabove defined further comprising the detachable portion having inner portions adhered with the adhesive at second selected locations between the first sheet and the second sheet within the card.

The card as described above is preferably cut from two similar sized printed master sheets (press sheets), which may contain space for many cards. In another alternate embodiment the first layer of cardstock is printed on both sides, yielding a message to the end-user, when the magnetic portion is removed.

The printing may be accomplished by means of the many printing processes in use, for example; silkscreen, offset, letterpress, inkjet, gravure, flexographic or laser digital. The use of a digital process enables variable data to be used to full advantage, particularly in placing varying prize or award messages under the removable magnet.

In a further aspect the invention provides a process a process of making a composite magnetic card comprising (a) feeding (i) a sheet of first material having a first printable face and a second face and comprising paper cardstock; and (ii) a sheet of a second material having a first printable face and a second printable face and comprising a magnetic material, to a printing press;

(b) printing desired designations on said first material first printable face and on said second material first printable face by said press;

(c) registering said sheet of first material with said sheet of second material in juxtaposition with each of said second faces facing each other;

(d) selectively applying an adhesive to effect adhesive bonding of said sheet of first material to said sheet of second material at said second faces to produce said composite magnetic card, but not at first selected locations between said first sheet and said second sheet within said card.

The process preferably further comprises printing desired designations on a second material second face.

The card and/or its removable magnetic piece, if included, may be of any imaginative shape and size that fulfills the needs of the advertiser, and acceptable as a postcard if mailed. This may be rectangular, for example, in the shape of common objects, such as a house or automobile, or a fanciful shape.

The cards according to and of use in the practice of the invention may be used, for example, but are not so limited selected from the group consisting of an advertising card, flyer, postcard suitable for mailing, lottery card, contest card, instant win, game card, educational information card, and the like, and business card.

BRIEF DESCRIPTION OF THE DRAWINGS

In order that the invention may be better understood, preferred embodiments will now be described, by way of example only, with reference to the accompanying drawings wherein:

FIG. 1 is a diagrammatic front view showing the front side of a card according to the invention;

FIG. 2 is a diagrammatic view showing the magnet snap-out side of the card of FIG. 1 with a single removable magnet die cut out;

FIG. 3 is a diagrammatic view of the address side of the card shown in FIG. 1 when used as a mailed postcard FIG. 4 is a diagrammatic view of the magnet "snap-out" side of the embodiment of FIG. 3 when used as a mailed postcard.

FIG. 5 is a diagrammatic cross sectional view across the thickness of the card with the orientation of FIG. 1;

FIGS. 6 and 7 represent cross sectional views of magnetization patterns through the card thickness of FIG. 1 in part;

FIG. 8 represents a plan view of magnetization patterns of varying pitches and patterns in cards according to the invention;

FIG. 9 shows an alternate embodiment of a card according to of the invention whereby the removable magnetic piece is on the address side of a postcard;

FIG. 10 shows an alternative embodiment of a card according to the invention whereby the removable magnetic piece reveals a printed message and/or image underneath;

FIGS. 11 and 12 are diagrammatic views of a master sheet with multiple cards and the imposition of variable data on both sides so as to produce a multiple of variable data magnetic advertising cards according to the invention;

FIGS. 11A and 12A are representative cross sections of the sheets of FIGS. 11 and 12 prior to bonding to each other;

DETAILED DESCRIPTION OF PREFERRED EMBODIMENTS

Figures 13, 14:
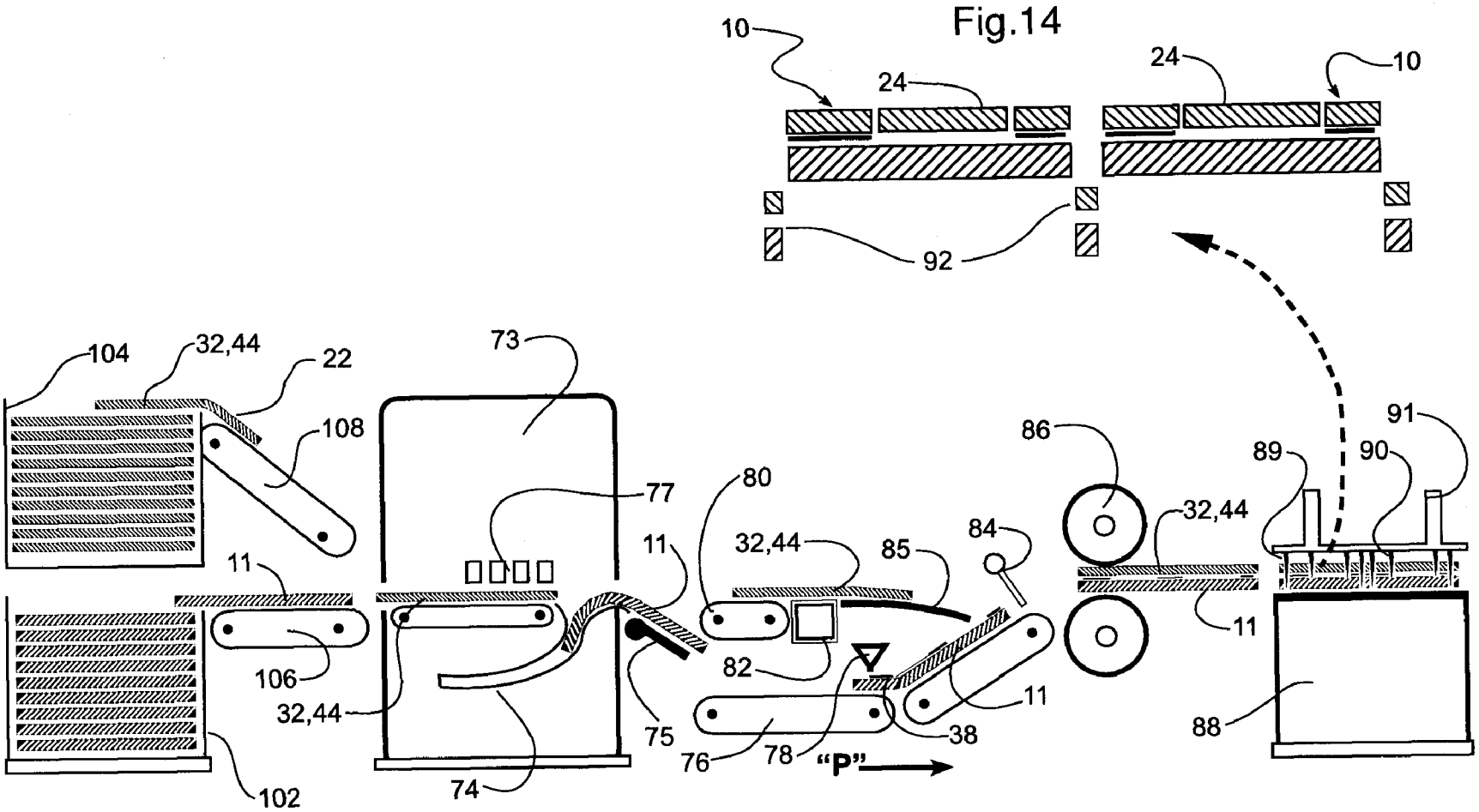
FIG. 13 represents a diagrammatic flow sheet of a sheet-fed digital press printing, bonding and die cutting manufacturing process according to the invention.
FIG. 14 shows an enlarged cross section of a card, as cut from a master sheet according to the invention.

Thus, the invention provides a new and advantageous composite magnetic card which is suitable for distribution or mass mailing to end-users. It is to be understood that the description terminology does not limit the uses of the invention.

With reference to the drawings in more detail, FIG. 1 and FIG. 2 illustrate the front and back sides, respectively, of a typical use of the invention as a reward or prize card shown generally as 10. Card 10 may be of any shape but is rectangular in the embodiment shown, and has an advertising face 12 as shown in FIG. 1. Card 10 is partly composed of a planar cardstock 11 (FIG. 5) which may be of any printable material, such as coated or uncoated paper, plastic or a combination of suitable materials.

The reverse side of card 10, as shown in FIG. 2, has a face 22 of a planar, printable coated paper. Alternative materials, such as uncoated paper, cardstock, plastic, metallized plastic, printable liquid-applied coatings or a combination of suitable materials may also be used. Face 22 has an area of a removable magnetic portion 24 as delineated by die cut line 26 of any desired practical shape.

There is a gap in the die cut at suitable locations 27, for example, which enables detachable portion 24 to remain integrally formed with the non-detachable magnetic material adhered to sheet 11, until its facile removal is desired by recipient. Thus, the uncovered surface of sheet 11 has no adhesive residue and is clear for satisfactory viewing.

The spacing and location of these gaps is determined by the shape, and the degree of tamper-evident security required. An advertising card with common low value prize, such as a discount off a future purchase would require little security for example. A varying and high value prize in a lottery would require a more tamper-evident design, and such designs are shown in detail in FIG. 17.

As shown in FIGS. 1 and 2, on card 10 there may be printed a plurality of text/images, either static or variable on both sides of the card, and hidden underneath the removable magnet 24. Such text or images are shown as 18 and 20 in FIGS. 1 and 30 and 28 in FIG. 2.

FIGS. 3 and 4 illustrate the front and back sides, respectively, of use of the invention as a postcard shown generally as 10. Card 10 may be of any shape acceptable for mailing purposes shape but is rectangular in the embodiment shown, and has an address face 12 as shown in FIG. 3. The construction of this version of the card is similar to that shown in FIG. 1 and FIG. 2. However in this case on face 12 of the material 11, conventional postal indicia or stamp 14 and address 16 are placed as well as a variable or an unchanging static text message 18 and a variable image 20 or an unchanging status, if so desired.

The reverse side of card 10, as shown in FIG. 4, has a face 22 of a planar, printable coated paper. Face 22 has an area of a removable magnetic portion 24 as delineated by die cut line 26 of any desired practical shape. As shown in FIG. 4, on card 10 there may be printed a plurality of text/images, either static or variable. These may be on the removable magnetic area portion 24, shown as 28, and/or as shown as 30 in the non-removable card area.

FIG. 5 shows a cross-sectional thickness view of card 10 in the orientation of FIG. 1 and FIG. 3 wherein the thickness has been exaggerated to better show the components clearly.

Cardstock 11 material is preferably of a thickness of 0.2 mm to 0.4 mm inches to provide sufficient stiffness and to provide a distance, i.e. space or gap between the coercive forces of magnetic layer 32 and any metallic surfaces encountered during any subsequent processing, or mailing and delivery of card 10 and to permit stacking and dispensing of cards without magnetic interference. A clear polymer layer 35 is, in this embodiment, optionally, laminated or liquid applied to layer 11.

Figure 15:
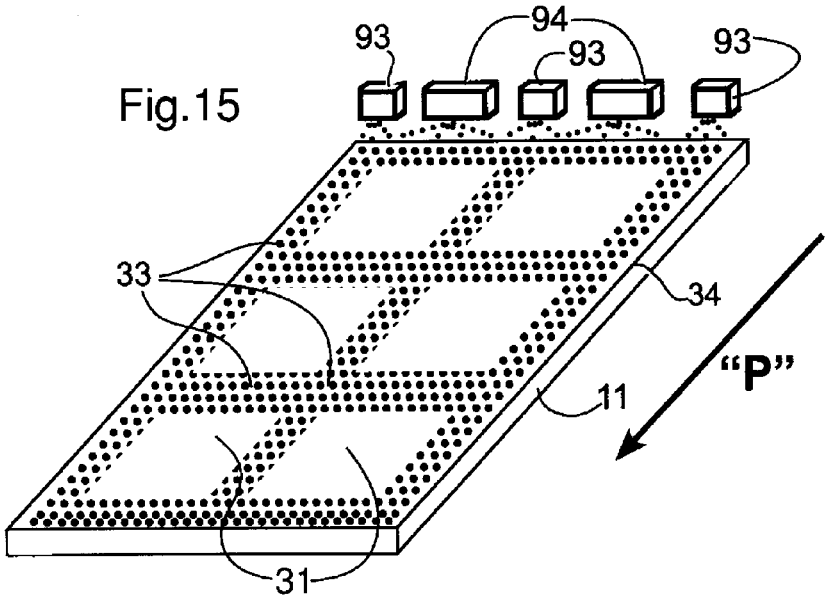
FIG. 15 represents the preferred method according to the invention of applying adhesive by doing so in selected rectangular areas only.
Figure 16:
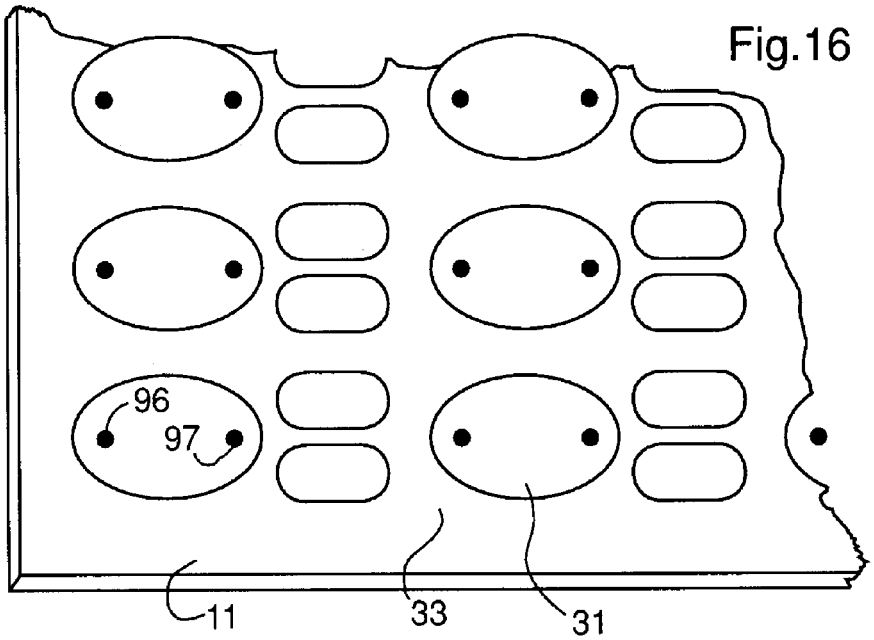
FIG. 16 represents an alternate method according to the invention whereby complex areas of adhesive application may be accurately applied.

Second face 34 of cardstock sheet 11 is bonded to first face 36 of magnetic layer 32 with a layer of adhesive 38 over selected locations only. This adhesive layer may be of any suitable adhesive e.g. a water based EVA (ethylene-vinyl acetate), acrylic or a heat-activated hot melt polymer. The permanent non-removable adhesive is applied to and bonds together with those selected portions 33 of sheet 11 where magnetic material 32 is not to be detached from card 10 as shown in FIG. 15 and FIG. 16, to leave portions 31 adhesive free.

Magnetic layer 32 consists of a calendared rubber or other flexible polymer material 32 having ferrite additives, which can be readily magnetized. Sheet 32 is preferably of a thickness of 0.15 mm to 0.3 mm and is commercially available. In the practise of the invention, it is preferably utilized in a non-magnetized form which facilitates its processing through printing presses containing steel rollers, trays and guides, in the size of the master sheet for print imaging or as a roll, bonded on its whole surface at face 40 to an inner face 42 of paper 44 by adhesive 46.

Adhesive 46 may be applied by the magnetic sheet manufacturer or applied by the advertising specialty or printing converter. The adhesive is most preferably of a permanent nature providing a contiguous bond between the two layers.

Material 44 is composed of any suitable material which most commonly would be paper, cardstock, synthetic paper, plastic film, a liquid applied printable polymer layer, or a metallic plastic film and having a suitable printable surface 22. The thickness and weight of this layer will preferably be the minimum needed to provide sufficient opacity and print quality. In the case of paper stock this minimum would be in the order of a 50 lb. (75 gm/sq.m) paper stock. A clear polymer layer 29 is, in this embodiment, optionally, laminated or coated with a clear protective liquid to layer 44. Cuts 26 are imparted by die cutting, the sharp steel rules of which cut through layers 44, 46 and 32 but not 11. Short gaps in the steel rule at selected locations do not cut layers 44, 46 and 32 or cut at a lesser depth. In this way, removable magnetic piece 24 is temporarily retained but easily detached from cardstock sheet 11 by bending card 10 to a small degree, gripping the removable portion and pulling it free.

In FIG. 6 the multi-pole magnetization pattern of magnetic layer 32 is shown with the poles North and South represented by the letters N and S respectively. This magnetization is imparted to sheet 32 prior to bonding to layer 11 in a commercial magnetizing machine. Sheet 32 passes over magnetizing rollers with its face 36 adjacent to the rollers to impart a multi-pole array into surface 36 with coercive forces 50 primarily extending outwards from face 36. Due to this one sided magnetization process, there is virtually no magnetic force extending in the opposite direction outward of face 40. The number of poles per cm is determined in the design of the magnetizing machine and affect the intensity of the magnetic force and its strength at a distance "d" from face 36. In conventional magnets of 0.3 mm to 0.75 mm thicknesses, the pole spacing is typically 5 poles/cm. In this embodiment of the invention, the pole pitch is preferable between 6 and 10 poles/cm to, thus reduce the distance "d" of its reach. For example, with a pole pitch of 7 poles/cm, the holding force is only 20% of full strength with a 0.30 mm gap, compared to 35% at 4 poles/cm, (Dexter Magnetic Technologies Permanent Magnet Catalogue, publisher and year, pp 29. 2006). In the practise of the present invention, the magnetization is designed to be such that only a minimal amount of, say, less than 20% remains beyond the gap provided by layer 11. The use of the gap provided by the layer 11 prevents card 10 from sticking to metallic surfaces, when not desired.

In FIG. 7, a refinement is made in the degree of magnetization across magnetic sheet 32 by adjustments in the operation of the magnetizing machine. In the areas not included in the removable portion 24, the magnetizing force is reduced so that the depth "d" of its reach is reduced to a lesser, distance "$d_2$" which is well within the thickness of layer 11. In this way the total amount of magnetic force in a card 10 may be reduced by approximately 20% to 40%. This facilitates card 10 when used as a postcard being processed for reduced postal rates in jurisdictions or countries with more sensitive automated postal sorting machinery or processing rules.

In FIG. 8 a further refinement is illustrated which is advantageous when a high level of fraud protection is required, such as in lotteries or higher prize value contests. Here the magnetic fields are shown as they would be visible with a magnetic field viewer, 47 which shows the pattern of the magnetic forces. The low cost magnetic viewer contains fine magnetic particles suspended in a plastic film and are readily available from scientific and educational material suppliers.

In the example, the pitch of the adjacent poles have been changed, as shown as $P_1$ to $P_5$, thus imparting a unique and easily verifiable pattern. This is accomplished by varying with metal spacers the distance between the annular magnets used in the magnetizing machine, wherein a series of these magnets placed on a rotating shaft, where the sheet passes in direction "P", causes the magnetization of the magnetic sheet on its face 36.

In another alternative enhancement, shown again in FIG. 8, a series of interruptions and/or distortions are caused in the magnetic field lines, all denoted here as points 51. This is created by placing row or rows of electromagnets or permanent magnets into or after the normal magnetizing process. By cycling these small electromagnets on and off or moving the permanent magnets toward and away from the magnetic sheet face 36, they disturb the local magnetization pattern, resulting in a distinct change or erasure of magnetization directly in the portion of the sheet in contact with the magnet. In this way a pattern can be created that is as distinctive as desired by varying the shape and size and duration of the electromagnet impulse or permanent magnet placement in contact with the sheet. By electronically programming these actions, each card can be encoded distinctly. With the above optical viewer or an appropriately configured electronic magnetic reader these patterns can be decoded. While still intact the card's magnetic force would not be readable since the magnetic field depth can be set to not extend beyond either card surface but once removed the magnet's unique pattern can be reliably read. A means of achieving this protection can be made through adjusting the thickness of sheet 11, adjusting the magnetic field strengths or the use of magnetically shielding inks or coatings.

Thus, the removable magnetic portion becomes itself the redemption piece, allowing an automated machine based identification and issuance of prizes or awards in lotteries, contests and rewards. This aspect of the present invention would be extremely advantageous due to the ongoing incidence of fraud from those responsible for selling and redeeming prior art instant win cards.

In an alternative embodiment for the cards postcard application, shown in FIG. 9, indicia 14 and address 16 information are on the same side of card 10 as die cut 26 and, thus, the detachable magnetic portion 24.

In FIG. 10, an alternative embodiment is shown which enables an advertiser to include a further incentive for an end-user to remove removable magnetic piece 24. In this optional embodiment, when cardstock 11 is printed, it is printed on both faces 12 and 34 prior to bonding to magnetic face 36 of magnetic layer 32. Thus, when magnetic piece 24 is removed, text 52 and/or images 54 will be revealed. Text 52 and images 54 may represent, for example, a time-limited offer, the image of a new product, or an invitation to visit a website to enter a contest, or to see more details of the advertisers offer to the end-user, or any offer or message as may be invented by advertisers. In the case of this embodiment, the present invention of bonding face 34 to magnetic sheet 32 with permanent adhesive only in the non-removable areas yields a clean advertising message surface with no adhesive residue.

A new and most advantageous of the cards according to this invention is that it allows, for the first time, the use of variable data from a digital press on a magnetic advertising substrate without the necessity of having to die cut the piece separate from the mailing enclosure or card, which, thus, avoids all the sorting and mismatching issues. In FIGS. 11 and 12, the front and back faces of a master sheet are shown. Side sectional views are shown in FIGS. 11A and 12A. To those skilled in the art of digital printing, it is normal to print a multiple number of paper cardstock personalized cards with variable data software. The following description illustrates how this art can now be applied for the first time to a postcard application containing a removable magnetic portion.

The personalized data such as name, address and variable images for each recipient on both sides of the card is simply shown as a number 60, 62, 64, 66, 68 and 70, in this embodiment, wherein each number relates to a separate recipient. As an example, the recipients could be vacation travel prospects and the text and images would not only have their addresses but an offer for a type of vacation that may appeal to them based on past purchases, as illustrated in FIGS. 11 and 12 by various vacation activity icons. These are printed on faces 12 and 22 so that when bonded, a two-sided personalized card is created. Additionally face 34 may also be printed in the same manner to create the hidden message as shown in FIG. 10. The composite sheets of FIGS. 11 and 12 are superimposed back-to-back along edges 71 and 72. Alternative joining of the two sides may be made on any face, depending on the equipment available; and the order of personalizing the full master sheet would be varied to suit.

Figure 17:
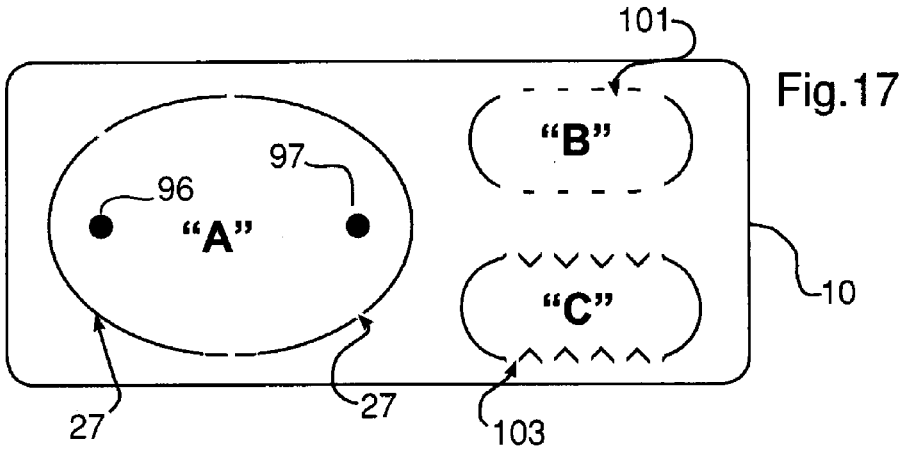
FIG. 17 is a diagrammatic front view of a contest card according to the invention; and wherein the same numerals denote like parts.

Instant win cards have been prone to various methods of fraud and tampering. In one prevalent method the retail merchant or distributor of the cards prior to sale or distribution attempts to "peek" at them to identify the biggest winning cards. The present invention offers some unique opportunities to prevent tampering. FIG. 17 shows card 10 with three removable sections "A", "B", "C" as an illustration. In removable magnet section "A" two spots of glue 96, and 97 have been applied inside the area bound by the first line of gaps 27 in the die line. When the magnet is partially removed to view the prize or code these spot points of adhesion will cause the underlying face to tear in a small adjacent area to yield clear evidence of tampering, by being non-replaceable, non-disguisably visible. Further, detachable portion will offer noticeably less resistance when removed, subsequently, after being earlier tampered.

In another method, in magnet section "B", wider gaps of between 0.4 mm and up to 2 mm as typical values, shown as 101, will cause the magnet to tear in a random, fashion, yet will still remain integral enough to expose the prize or winning code. In section "C" a zig-zag die with gaps 103 will create a non-replaceable, non-disguisable, visible tear in the areas adjacent to the die cut lines of the removal, detachable portion. In a practical example the keepsake souvenir magnet may have a small number of relatively small gaps of say 0.4 mm, yielding a smooth, aesthetically pleasing finished shape. The high value prizes may then utilize the underlying adhesive spots 96, 97 or a pattern as described above for sections "B", and "C".

A practical manufacturing process of producing a card according to the invention is shown in FIG. 13.

Cardstock 11, and composite of magnetic material sheet 32 and a printable layer or coating 44, with its face 22 upwards, each having the same master sheet area dimensions are fed from feed trays 102 and 104, respectively, by conveyers 106 and 108, respectively, to digital printing press 73 in turn. The printing software is programmed such that sheet 11 is fed first and followed by composite sheet 32 and 44, and each is imaged on the top face with the correct layout and location of images through the digital printing heads 77.

Sheet 11 then passes through a duplexer 74 contained in the machine to flip it over so that it exits press 70, with the printed face down. The same duplexer may also be used to image the other side of cardstock 11 if so desired. In addition, the second side of composite sheet 32 and 44 may also be printed if a print receptive surface is available. Such a process may be carried out with the invention in commercial digital printing machines, such as, for example, Konica Minolta C6500® or HP Indigo® or Xerox IGen®.

Upon exiting printing press 73, sheets 11, and composite sheet 32 and 44, are directed towards either an upper or lower conveyor by a paddle 75 which, transfers cardstock 11 to lower conveyor 76 for adhesive pattern application 78, and composite sheet 32 and 44, to upper conveyor 80 to be magnetized 82. After this, a registration mechanism 84 holds lower sheet 11 in place momentarily, while upper composite sheet 32 and 44 proceeds down ramp 85 and is registered with its leading edge. The two attached sheets are then sent through pressure roller 86 to ensure a solid wrinkle free bond. Subsequently, the bonded composite sheet is placed in die cutter 88 which cuts out card 10 to provide it with its removable magnetic piece 24, of, essentially, the desired shape but leaving sufficient and suitably located minor uncut portions remaining integrally with the remaining magnetic material to hold the detachable portion to card 10. This is accomplished through striking the composite with die assembly 91 in which die knives 90 which cut on the perimeter of the removable portion 24 partially through the composite and by knives 89 which cut through completely and define the size and shape of card 10.

Rather than using a die cutter the individual cards may also be cut from the master sheet by means of a guillotine as well.

In FIG. 14 an enlarged section of the cut sheet is shown with cards 10 removed leaving trim 92, each card 10 containing the removable magnetic piece or pieces 24.

The cards according to the invention may also be produced on a sheet-fed offset ink process press, or ink jet printers instead of the digital press. In addition, the process could be carried out with sheet materials being fed and printed in a roll form, and with magnetic sheet 32 being bonded to a face sheet or being coated with a liquid polymer having a printable surface, in situ rather than being supplied pre-bonded. As well an intermediate polymer film laminating section or a liquid UV light cured section could apply protective films as shown as layers 29 and/or 35 in FIG. 3. to one or both external faces for appearance reasons.

FIG. 15 shows a form of adhesive application pattern to provide the absence of adhesive in the removable magnet area wherein sheet 11 moves along a belt in the direction "P" passing under adhesive applicators. The adhesive may be commercially available and selected, for example, from thermoplastic polymers e.g. hot melt adhesives, water based emulsions, or solvent based adhesives. The may be applied by roller, spray, nozzle or slot or other means. The curing method may be, for example, ambient air cure, a convective heat tunnel, a radiant heat tunnel, ultraviolet lamp curing or radio frequency curing. Preferred applicators consist of a series of application heads 93 which cycle on and off only at the front and back of the sheet or individual card edges. Intermediate application head 94 are programmed to cycle on and off based on the dimensions of the size and shape of removable magnet area.

In FIG. 16, a plan view is shown of an alternate adhesive method used to create a more complex pattern than that the rectangular patterns that can be achieved with nozzles. In this case a screen printing press is fitted with a screen in the pattern shown with in FIG. 16. Rather than ink, a screenable adhesive is applied through the screen in the areas marked 33. This type of semi-automatic or automatic press is commercially available and can be installed either inline as part of the process described in FIG. 13 or offline if so desired. Once bonded together and die cut, adhesive bonding can be created accurately following a complex shape including adding the adhesive spots 96 and 97, as explained in FIG. 17.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. A composite magnetic card for bearing printed data comprising (a) a first planar sheet having a first face and second face;

(b) a second planar sheet comprising a magnetic material having a magnetic first face and a second face and defining at least one detachable portion defined by a die cut while having suitably located portions integrally retained to non-detachable magnetic material of said second planar sheet;

wherein said first sheet first face is sufficiently and suitably adhered with an adhesive to said second sheet first face to retain said detachable portion of said second sheet to said first sheet but wherein said adhesive is not disposed at first selected locations at the detachable portion between said first sheet and said second sheet within said card.

2. A card as claimed in claim 1 wherein said first sheet first face bears printed designations thereon.

3. A card as claimed in claim 1 wherein said first sheet second face bears printed designations thereon.

4. A card as claimed in claim 1 wherein said second sheet first face bears printed designations thereon.

5. A card as claimed in claim 1 wherein said second sheet second face bears printed designations thereon.

6. A card as claimed in claim 1 wherein at least one portion of said second sheet is detachable from said first sheet.

7. A card as claimed in claim 1 wherein each of said first and second sheets comprise a laminate with a clear polymer film or layer upon or under which said printed designations are printed.

8. A card as claimed in claim 1 selected from the group consisting of an advertising card, flyer, postcard suitable for mailing, lottery card, contest card, game card, educational information card and business card.

9. A card as claimed in claim 1 wherein said magnetic material is of a selected pole configuration and magnetic strength and said first sheet is of a thickness that provides essentially zero magnetic field outwardly of said first sheet.

10. A card as claimed in claim 1 having distinctive magnetic field strength identification means.

11. A card as claimed in claim 1 wherein said magnetic material provides said card with portions having a plurality of various magnetic field strengths.

12. A card as claimed in claim 1 wherein said magnetic material provides said card with portions having a plurality of various distances between magnetic force lines.

13. A card as claimed in claim 1 to wherein said magnetic material provides said card with a distinctive pattern of magnetization across the card.

14. A card as claimed in claim 1 further comprising tamper-evidence means comprising said die-cut having a die-cut line so shaped as to provide said suitably located portions integrally retained to said non-detachable magnetic material.

15. A card as claimed in claim 14 wherein said die-cut line is of a zig-zag shape.

16. A card as claimed in claim 14 wherein said suitably located portions integrally retained in said non-detachable magnetic material at said die cut line are separated by die-cut inter-portion distances are suitably selected from about 0.4 mm to about 2 mm are present.

17. A card as claimed in claim 1 further comprising said detachable portion having inner portions adhered with said adhesive at second selected locations between said first sheet and said second sheet within said card.

18. A process of making a composite magnetic card comprising (a) feeding to a printing press (i) a sheet of first material having a first printable face and a second printable face; and (ii) a sheet of a second material comprising magnetic material having a first printable face and a second printable face and defining at least one detachable portion defined by a die cut while having suitably located portions integrally retained to non-detachable magnetic material of said second material;

(b) printing desired designations on said first material first printable face and on said second material first printable face by said press;

(c) registering said sheet of first material with said sheet of second material in juxtaposition with each of said second faces facing each other;

(d) selectively applying an adhesive to effect adhesive bonding of said sheet of first material to said sheet of second material at said second faces to produce said composite magnetic card but not at first selected locations at the detachable portion between said first sheet and said second sheet within said card.

19. A process as claimed in claim 18 further comprising cutting an outline on said card through said second material to define a desired shape of the detachable portion.

20. A process as defined in claim 19 comprising cutting a plurality of outlines defining a plurality of desired shapes to produce a plurality of detachable magnetic material portions.

21. A process as defined in claim 18 further comprising printing desired designations on said first material second face.

22. A process as defined in claim 18 further comprising printing desired designations on a second material second face.

23. A process as defined in claim 18 further comprising cutting said composite magnetic sheet into a plurality of cards of smaller dimension.

* * * * *